US008251542B1

(12) United States Patent
Camerano

(10) Patent No.: US 8,251,542 B1
(45) Date of Patent: Aug. 28, 2012

(54) DECORATIVE LIGHT SYSTEM

(76) Inventor: Samuel Camerano, Phoenix, AZ (US)

( * ) Notice: Subject to any disclaimer, the term of this patent is extended or adjusted under 35 U.S.C. 154(b) by 237 days.

(21) Appl. No.: 12/688,230

(22) Filed: Jan. 15, 2010

Related U.S. Application Data

(60) Provisional application No. 61/145,326, filed on Jan. 16, 2009.

(51) Int. Cl.
*F21S 4/00* (2006.01)

(52) U.S. Cl. ..... 362/249.06; 362/121; 362/231; 362/301; 362/806; 362/807; 40/219

(58) Field of Classification Search ..... 362/121, 362/231, 298–301, 343, 806, 807, 812, 249.06; 40/219
See application file for complete search history.

(56) References Cited

U.S. PATENT DOCUMENTS 4,164,823 A * 8/1979 Marsico ..... 40/427
5,951,143 A * 9/1999 Ginsberg ..... 362/806

* cited by examiner

*Primary Examiner* — Stephen F Husar
(74) *Attorney, Agent, or Firm* — Kenneth L Tolar

(57) ABSTRACT

A light system includes a housing configured to resemble any seasonal or other desired image, i.e., a star, a pumpkin, an Easter egg, a firecracker, etc. The housing includes a rear face, a front face and a peripheral frame with a light-refracting chamber formed therebetween. The peripheral frame includes a plurality of tricolor LED's mounted therein. The rear face of the housing includes a completely-reflective front surface that deflects 100% of all impacting light beams inwardly toward the front face. However, the rear surface of the front face is only partially-reflective so that only a portion of impacting light is reflected back toward the rear face; a remaining portion of impacting light exits the front face and is visible to those nearby. Accordingly, the light generated by the limited number of LED's will create an illusion that an infinite number of light beams are emanating from the housing.

7 Claims, 1 Drawing Sheet

DECORATIVE LIGHT SYSTEM

CROSS REFERENCE TO RELATED APPLICATIONS

This application is entitled to the benefit of provisional application No. 61/145,326 filed on Jan. 16, 2009, the specification of which is incorporated herein by reference.

BACKGROUND OF THE INVENTION

The present invention relates to a uniquely-designed decorative light system that utilizes a minimal number of lights to create the illusion that an infinite number of lights are illuminated.

DESCRIPTION OF THE PRIOR ART

A myriad of decorative light systems exist in the prior art. However, conventional systems include multiple lights or LED's arranged in a mundane array or pattern. Accordingly, there is currently a need for a light system that creates a unique aesthetic effect as compared to conventional light systems. The present invention addresses this need by providing a light system that includes a minimal number of lights positioned between a fully-reflective mirror and a partially-reflective mirror to create an infinitely-increasing number of light beams.

SUMMARY OF THE INVENTION

The present invention relates to a light system including a housing configured to resemble any seasonal or other desired image, i.e., a star, a pumpkin, an Easter egg, a firecracker, etc. The housing includes a rear face, a front face and a peripheral frame with a light-refracting chamber formed therebetween. The peripheral frame includes a plurality of tricolor LED's mounted therein. The rear face of the housing includes a completely-reflective front surface that deflects approximately 100% of all impacting light beams inwardly toward the front face. However, the rear surface of the front face is only partially reflective so that only a portion of impacting light is reflected back toward the rear face; a remaining portion of impacting light exits the front face and is visible to those nearby. Accordingly, the light generated by the limited number of LED's will create an illusion that an infinite number of light beams are emanating from the housing.

It is therefore an object of the present invention to provide a light system that creates a unique aesthetic effect.

It is another object of the present invention to provide a light system that uses a limited number of LED's to create an illusion that light is emanating from an infinite number of LED's.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
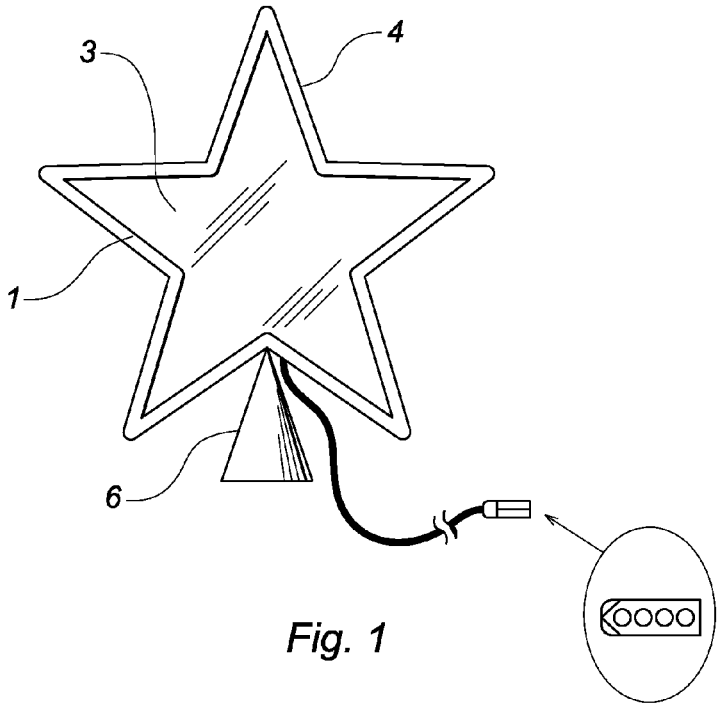
FIG. 1 is a front, plan view of the housing configured according to one embodiment of the present invention.
Figure 2:
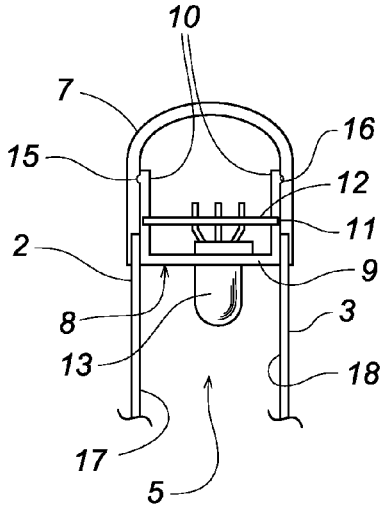
FIG. 2 is a side, sectional view of the housing peripheral frame.
Figure 3:
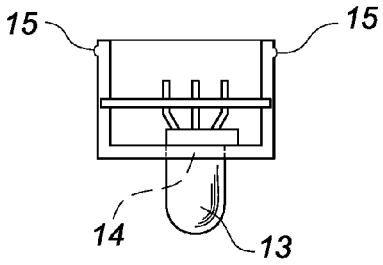
FIG. 3 is a sectional view of the LED mounting channel.
Figure 4:
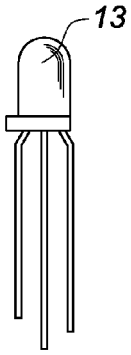
FIG. 4 is an isolated view of an exemplary LED.
Figure 5:
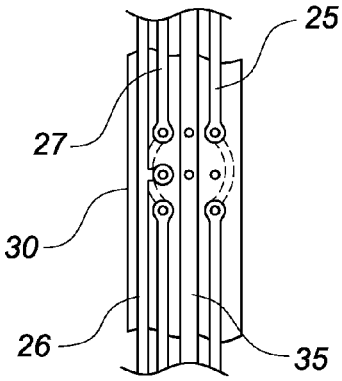
FIG. 5 is a detailed view of the LED circuit board.

The present invention relates to a light system including a housing configured to resemble any seasonal or other desired image, i.e., a star 1, a pumpkin, an Easter egg, a firecracker, etc. The housing includes a rear face 2, a front face 3 and a peripheral frame 4 with a light-refracting chamber 5 formed therebetween. The housing may include a cone 6 or similar fastener for mounting the device atop a Christmas tree or on another support structure, i.e., a wall.

The peripheral frame is formed of a substantially U-shaped cover 7 having a U-shaped, LED mounting channel 8 received therein. The channel includes a base panel 9 with a pair of side panels 10 perpendicularly extending therefrom. The side panels include a notch 11 for receiving an edge of a flexible circuit board 12 having a plurality of tricolor LED's 13 mounted thereon. Each LED is positioned within a designated passageway 14 on the base panel and extends into the refraction chamber. A projection 15 on the outer surface of each side panel seats within an indention 16 on the inner surface of the cover.

The rear face of the housing includes a completely-reflective front surface 17 that deflects 98-100% of all impacting light beams inwardly toward the front face. However, the rear surface 18 of the front face is only partially-reflective (approximately 50% efficiency) so that only a portion of impacting light is reflected back toward the rear face; a remaining portion of impacting light exits the front face and is visible to those nearby.

The tricolor LED's include a substrate 30 having four circuits bonded thereto to illuminate any number or combination of three colors at one time, i.e., red 25, green 26 and blue 27. The substrate also includes a common circuit 35 in communication with all three colored portions of each LED. LED operation is manipulated with a multifunction controller and integral microprocessor. The controller includes a selection dial that illuminates the LED's in any one of a plurality of display formats such as those listed below:

| Selection | Light Format |
|---|---|
| 1 | Green, blue, red all on at maximum brightness |
| 2 | Green, blue, red all on a ½ maximum brightness |
| 3 | Green only, flashing at user-selected intervals |
| 4 | Red only, flashing at user-selected intervals |
| 5 | Blue only, flashing at user-selected intervals |
| 6 | Green, red, and blue, one after another, flashing at user-selected intervals |
| 7 | Green, red, and blue, one after another, fading in and out at user-selected rate |
| 8 | Green, red, and blue waving in and out at a user-selected rate |

Accordingly, the light generated by the limited number of LED's will create an illusion that an infinite number of light beams are emanating from the housing.

The above-described device is not limited to the exact details of construction and enumeration of parts provided herein. For example, though the light source has been primarily depicted and described as LED's, any conventional light producing element can be used such as, but not limited to, fiber optics or glass lights. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A light system comprising:

a housing configured to resemble a desired image, said housing having a rear face, a front face and a peripheral frame with a light-refracting chamber formed therebetween, said peripheral frame formed of a cover having a mounting channel received therein, said rear face having a completely-reflective front surface that deflects substantially all impacting light beams inwardly toward said front face, said front face having a partially-reflective rear surface;

a circuit board received within said mounting channel, said circuit board having light-producing elements mounted thereon, each of said light-producing elements extending into said light-refracting chamber for projecting multiple rays of light into said light-refracting chamber and which are completely redirected toward said partially-reflective front face whereby only a portion of said rays are reflected back toward the rear face while a remaining portion of said rays exit the front face and are visible to those nearby.

2. The light system according to claim 1 wherein said mounting channel includes a base panel with a pair of side panels extending therefrom, each of said side panels having a notch thereon that receive said circuit board.

3. The light system according to claim 2 wherein each of said light-producing elements is positioned within a designated passageway on said base panel.

4. The light system according to claim 2 wherein each of said side panels includes a projection that seats within an indention on said cover.

5. The light system according to claim 1 further comprising a control means for selectively activating any number of said light-producing elements in a desired order, duration, intensity and pattern.

6. The light system according to claim 1 wherein said housing includes a fastener for mounting the device on a support structure.

7. The light system according to claim 1 wherein each of said light-producing elements is a multicolored LED.

* * * * *